US007500544B2

(12) United States Patent
Hakala et al.

(10) Patent No.: US 7,500,544 B2
(45) Date of Patent: Mar. 10, 2009

(54) ELEVATOR SYSTEM AND METHOD FOR VERIFYING A DESTINATION CALL

(75) Inventors: Harri Hakala, Hyvinkää (FI); Marjukka Mäkelä, Helsinki (FI); Tomi Sipilä, Espoo (FI)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 11/812,670

(22) Filed: Jun. 20, 2007

(65) Prior Publication Data

US 2008/0011557 A1 Jan. 17, 2008

Related U.S. Application Data

(63) Continuation of application No. PCT/FI2005/000486, filed on Nov. 14, 2005.

(30) Foreign Application Priority Data

Feb. 4, 2005 (FI) ..... 20050130

(51) Int. Cl.
*B66B 1/18* (2006.01)

(52) U.S. Cl. ..... 187/382; 187/388

(58) Field of Classification Search ..... 187/380–388, 187/391–393, 396
See application file for complete search history.

(56) References Cited

U.S. PATENT DOCUMENTS 4,972,926 A * 11/1990 Tsuji et al. ..... 187/380
5,952,626 A 9/1999 Zaharia
5,984,051 A * 11/1999 Morgan et al. ..... 187/392
6,109,396 A * 8/2000 Sirag et al. ..... 187/381
6,202,799 B1 * 3/2001 Drop ..... 187/388
6,397,976 B1 6/2002 Hale et al.
6,801,792 B1 * 10/2004 Schuster et al. ..... 455/566

FOREIGN PATENT DOCUMENTS

JP 2004-262619 A 9/2004
JP 2004-315127 A 11/2004

* cited by examiner

*Primary Examiner*—Jonathan Salata
(74) *Attorney, Agent, or Firm*—Birch, Stewart, Kolasch & Birch, LLP

(57) ABSTRACT

A method and apparatus for verifying destination calls needed in an elevator system. In the method a person having entered a destination call is identified first on the floor level outside the elevator and again in the elevator car allocated to the person. The destination floor call received from a destination call device as well as starting floor information obtained from a detector used to identify the person having entered the call are transmitted to the elevator control system, which, based on the destination call, allocates an elevator to the person having entered the call. If the system identifies the person having entered the call when the person is in the elevator car, then the destination call is acknowledged in the system as executed. On the other hand, if the person having entered the call is not identified in the elevator car allocated to him/her, then the previously entered destination call is kept valid and a new elevator is allocated to the person having entered the call.

20 Claims, 4 Drawing Sheets

ELEVATOR SYSTEM AND METHOD FOR VERIFYING A DESTINATION CALL

Figure 1:
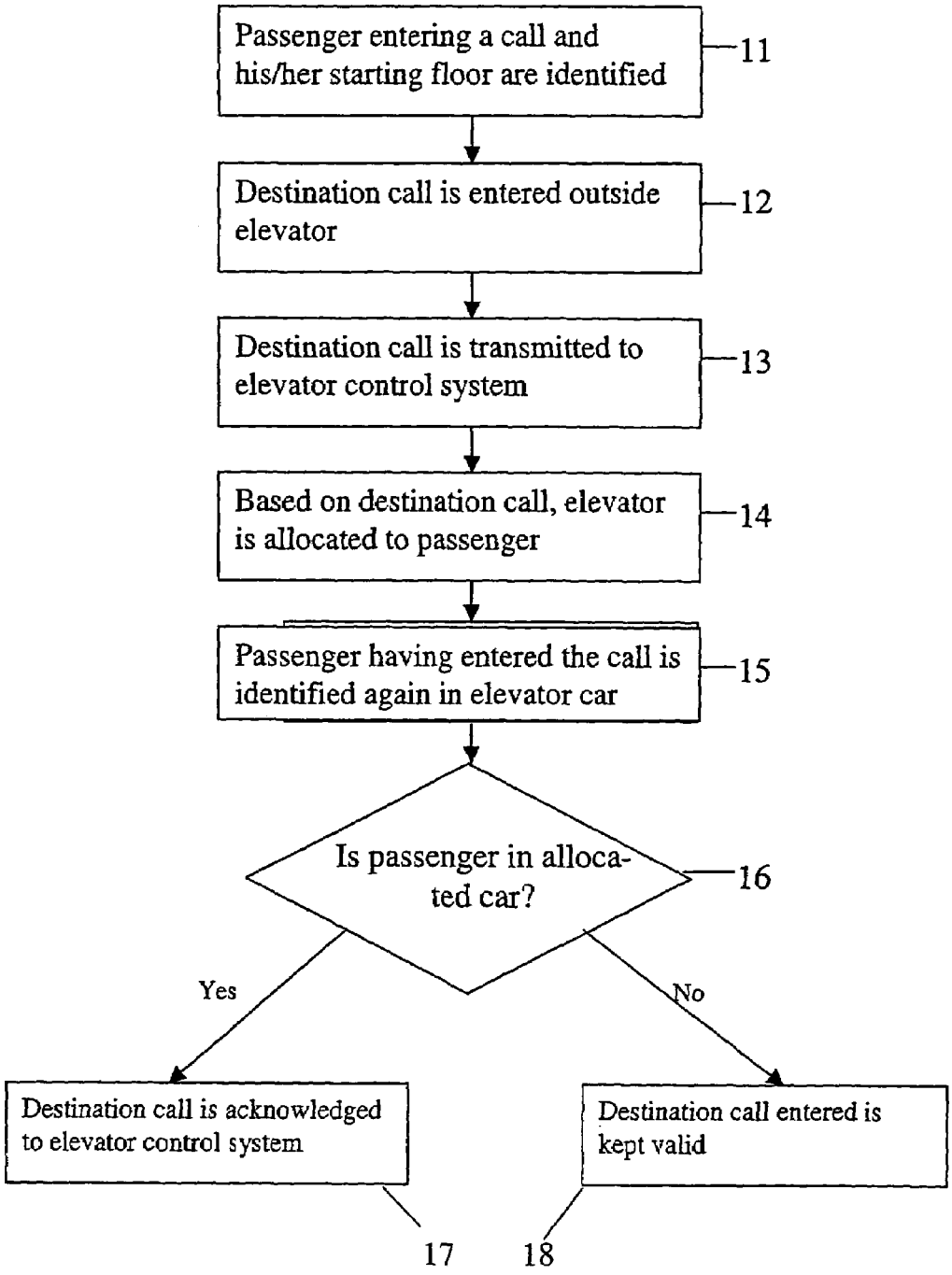

This application is a Continuation of copending PCT International Application No. FI2005/000486 filed on Nov. 14, 2005, which designated the United States, and on which priority is claimed under 35 U.S.C. § 120. This application also claims priority under 35 U.S.C. § 119(a) on Patent Application No(s). 20050130 filed in Finland on Feb. 4, 2005. The entire contents of each of the above documents is hereby incorporated by reference.

FIELD OF THE INVENTION

The present invention relates to call input in an elevator system. In particular, the invention concerns a method and system for verifying an entered destination call using identification of the person having entered the call.

BACKGROUND OF THE INVENTION

In the operation of an elevator system, an essential piece of information is the call data entered by users to define their destination floor. A passenger using the elevator system has to inform the control system of the elevator system regarding both his/her own arrival floor and his/her destination floor that the user is heading for. Traditionally, these call data items are entered by the passenger in two steps by first entering a hall call on his/her arrival floor typically by pressing arrow buttons and then, upon arrival of an elevator at the passenger's starting floor, entering his/her destination floor data to the system by pressing a car call button placed in a control panel inside the elevator car. Due to its two-step nature, the traditional system requires that the elevator passenger enter two separate calls for one elevator ride, unless an elevator happens to be present at the passenger's arrival floor or unless another person traveling in the same direction has entered a hall call.

The number of calls to be entered for one elevator ride can be reduced to one by using a so-called destination control system. In the destination control system, the passenger feeds his/her destination floor call into a destination call device while still outside the elevator on a floor level. Thus, the user only has to enter a call once as the up and down calls are omitted. Based on this one call, the elevator system allocates the most suitable elevator to the customer, and when the customer boards the elevator car no separate destination call needs to be entered in the car.

Destination control requires the use of a special destination call device that allows the input of all possible floor numbers and floor identifiers to the elevator control system. Often the destination call device contains numeric keys 0-9 for the input of calls. A destination call can also be entered to the elevator system via a wireless and portable transmitter. The call can be registered in the elevator control system in the same way as if the call had been entered via a traditional control panel in the car. The destination floor can be selected by keying in the desired floor into the portable transmitter. A receiver for receiving the destination call as well as the associated antenna may be placed in the lobby or in the control panel of the elevator car. It is thus possible to input a destination call by wireless means from the lobby from outside the car.

The destination call regarding the destination floor entered by the user as well as the starting floor data obtained from the destination call device are transmitted to the elevator control system for elevator allocation. The person having entered the destination call is guided by means of the call device to the elevator allocated to him/her.

A problem with prior art solutions is that the user does not necessarily board the elevator allocated to him/her. The elevator control system never gets information indicating that the person having entered a call does not board the elevator intended for him/her e.g. in a case where the elevator allocated to the person is full. Neither is the elevator control system informed that the person having originally entered the destination call is still waiting for an elevator and that a new elevator should be allocated to him/her.

OBJECT OF THE INVENTION

The object of the present invention is to disclose a method and system for verifying a destination call by identifying the person having entered the call in the lobby by means of an identifier and by identifying the person having entered the call again in the elevator car.

BRIEF DESCRIPTION OF THE INVENTION

As for the features of the invention, reference is made to the claims.

The method and system of the invention are characterized by what is disclosed in the characterization parts of claims 1 and 9. Other embodiments of the invention are characterized by what is disclosed in the other claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in connection with other embodiments.

The present invention defines a method and an apparatus for verifying destination calls in an elevator system by identifying the person having entered a call first outside the elevator and again in the elevator car allocated to the person having entered the call.

In an embodiment, Bluetooth technology is used as the user interface of the elevator system and the user's portable telephone serves as a call device. A connection can be established e.g. when the user arrives in the elevator lobby. To allow a connection to be set up, the lobby on each floor is provided with one or more base stations, which are connected to the control system of the elevator system and which are used to establish a wireless connection to the terminals.

Another embodiment allows utilization of RFID technology in the communication between the person entering the call and the elevator system control. The user has an RFID identifier whereby a remote reader placed in the lobby automatically identifies the user. The RFID identifier may be e.g. an access card of a regular user of the building, containing one or more quick selection alternatives programmed specifically for each user. The access card thus functions as a means of user identification and as a call device for the entry of a destination call.

One embodiment of the invention is the use of bar codes in the call device and the use of a bar code reader connected to the system control. A call is entered by showing the desired code to the optical reader and covering the other codes visible on the card.

In another embodiment of the invention, the destination call device provides a possibility to display a number of user-specific favorite floors and to enter a call to one of these favorite floors of the user. When the owner of the call device is identified, the system control takes into use the user profile concerning the user in question and presents this user's quick selection alternatives on the display.

The user can enter his/her destination floor selection on the floor level already before arriving to the elevator. The destination floor selection is combined with the starting floor data obtained about the user's location, and this pair of call data items is transmitted to the elevator control system for elevator allocation.

Once the call has been processed and an elevator assigned to serve it, the user is identified again as he/she enters the allocated elevator car. The elevator car is provided with a second remote reader, base station or other identifying device, which identifies in the elevator car the person having entered the destination call and indicates to the elevator group control system that the call relating to the person can be acknowledged. However, if the passenger does not enter the elevator allocated to him/her, an elevator serving the user is allocated again.

For example, in a situation where the elevator allocated to the person having entered a destination call is full, the user may have to wait for the next elevator. In this case, the elevator control system infers or is informed that the original destination call should still be valid and the control system should allocate a new elevator to the person having entered the destination call.

The invention makes it possible for the elevator control system to be accurately informed as to whether a passenger having entered a call boarded the elevator car allocated to him/her or not. This enables the control system to allocate elevators to passengers more accurately on the basis of calls entered.

LIST OF FIGURES

Figure 2:
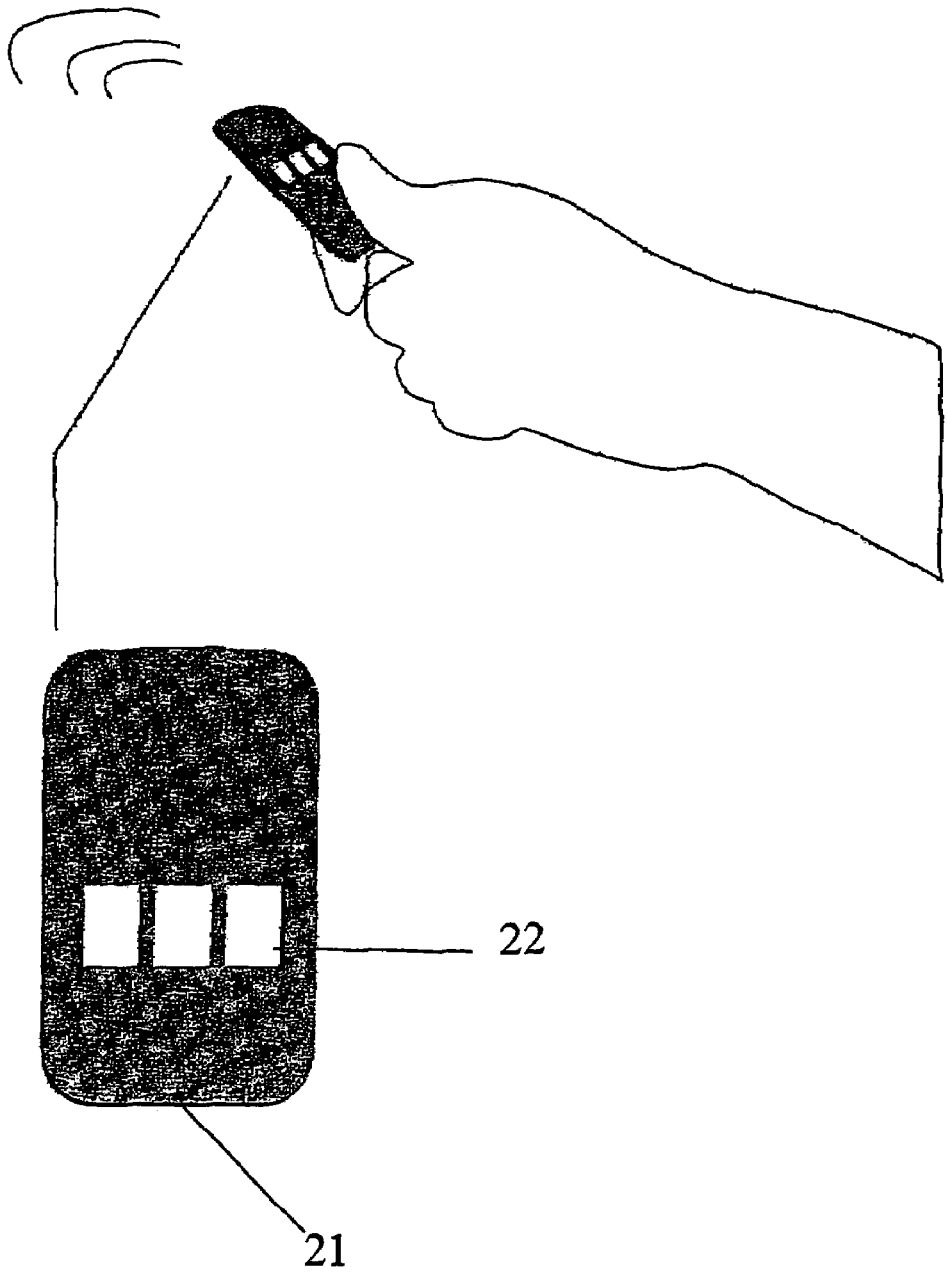
Figure 3A:
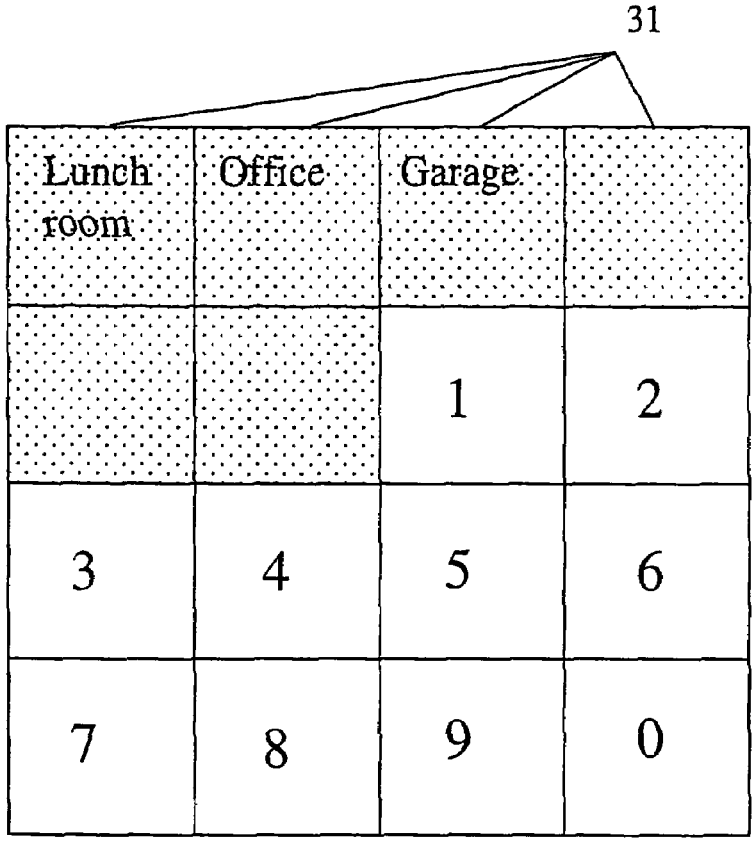
Figure 3B:
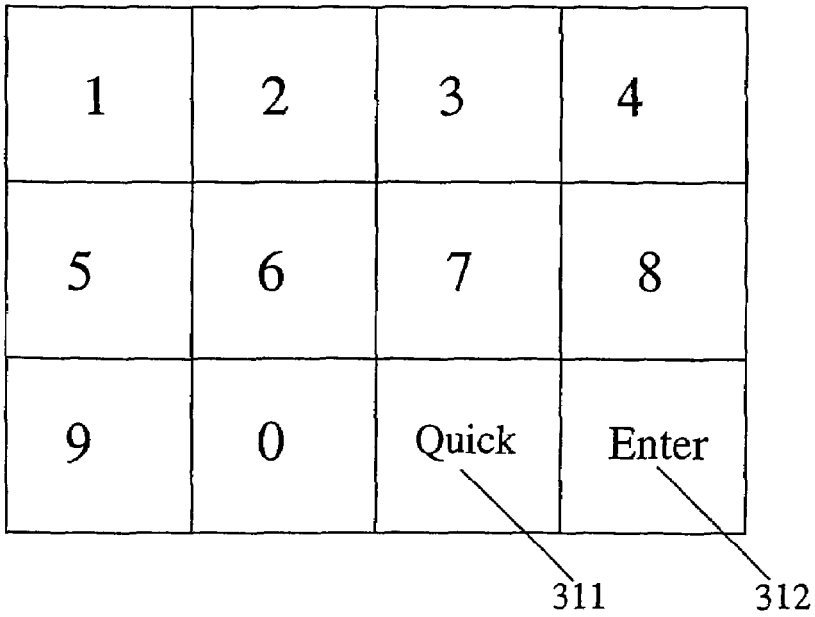
Figure 4:
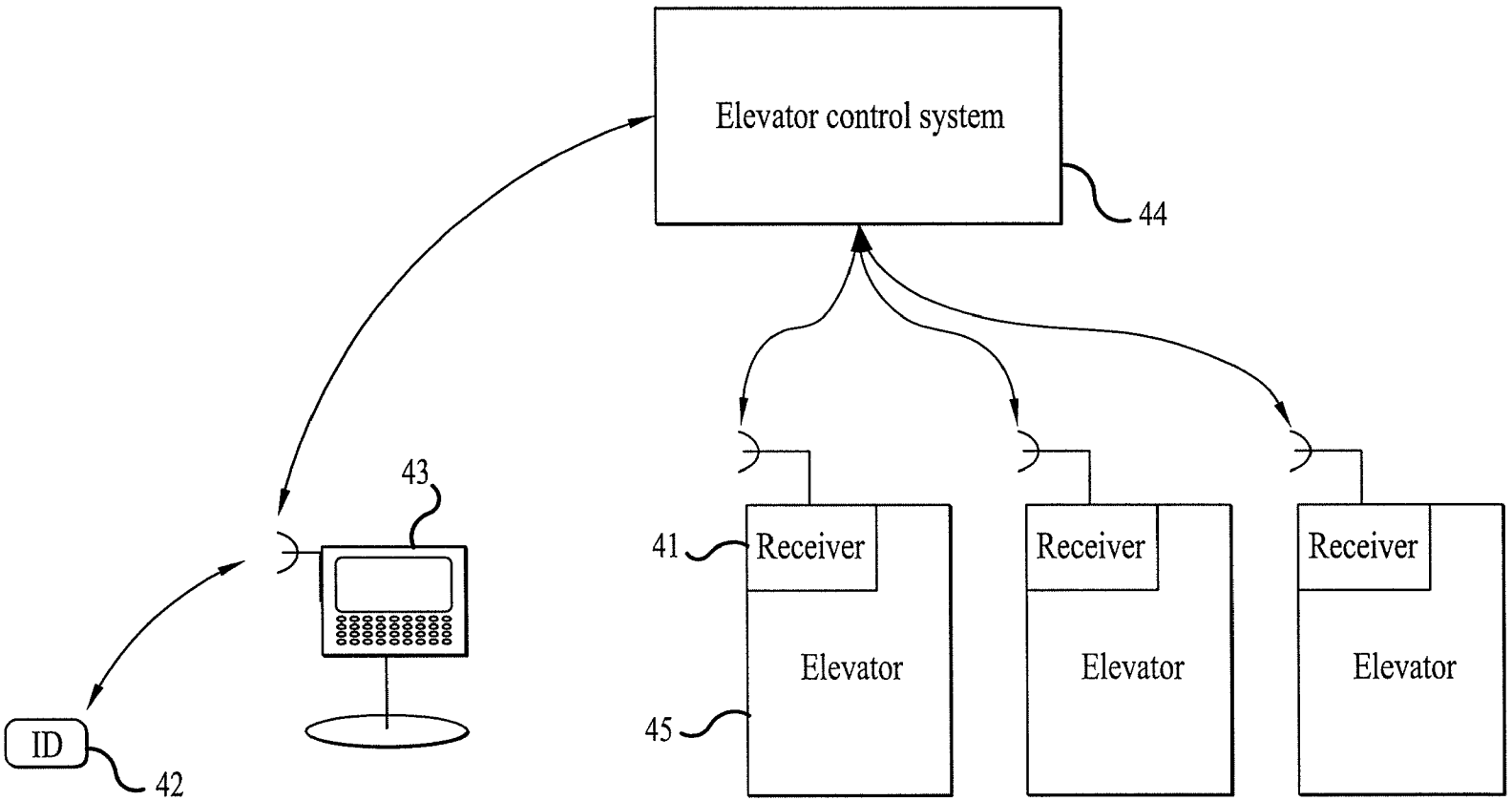

FIG. 1 presents a block diagram of the method of the present invention,

FIG. 2 presents an example of a call device according to the present invention, FIGS. 3*a* and 3*b* present two separate examples of the display of the elevator call device according to the invention, and, FIG. 4 presents an example of the elevator system of the invention.

BRIEF DESCRIPTION OF THE INVENTION

The present invention discloses a method and an apparatus for verifying a destination call in an elevator system.

FIG. 1 presents a diagram representing the method of the present invention. The user is identified in the elevator lobby for the first time (11), and the user then enters a destination call by means of a destination call device (12). The destination call together with starting floor data obtained from a remote reader, base station or other identifying device is transmitted to the elevator control system (13), which, based on the destination call (14), allocates an elevator to the person having entered the call.

When the elevator allocated to the person having entered the destination call arrives at the starting floor and the person having entered the destination call boards the elevator, a second remote reader, base station or other identifying device identifies the user again (15). Once the person having entered the destination call has been identified, the destination call is acknowledged in the elevator control system as executed (17). If the person having entered the call does not board the elevator allocated to him/her, then the previously entered destination call is kept valid (18) and another elevator is allocated to the person having entered the call.

FIG. 2 presents an identifier card (21) utilizing RFID technology for user identification. The RFID identifier card may serve as the elevator user's call device, in which case the elevator lobby has to be provided with a reader device. The RFID identifier card of regular users of the building may be e.g. an access card with one or more RFID resonant circuits. Each circuit comprises a switch that can be used to close the circuit and to activate the RFID function. It is possible to integrate in the card e.g. three RFID resonant circuits and three bubble switches (22), allowing each RFID resonant circuit to be activated by pressing one of the switches.

Thus, when walking past a remote reader, the user can enter a destination call using his/her own access card by closing the desired resonant circuit by pressing a bubble switch. Each bubble switch on the card corresponds to one preselection alternative programmed for the user's favorite floor on the basis of the user profile or, in the case of a low building, each floor can be set separately behind a given switch. In this way, the resonant circuit functions as a transponder, i.e. as an identification tag while an RFID transmitter connected to the system control serves as a reader device. When the identification tag comes within the range of the field transmitted by the reader device, the identification tag sends the information stored in it to the reader device. In addition to user identification, the user's RFID card can thus also function as a destination call device or in user access control so that each access card holder is only allowed access to certain destinations.

The access card can also be provided with bar codes on either side. The reader device in the system is a bar code reader, such as those used e.g. with cash registers at grocery stores. A call is entered by showing the desired code to the reader while hiding the other codes visible on the card. When showing the card to the reader, the user can hide one of the two codes, there being four preselectable floors. By modifying the card, more alternatives regarding selectable floors can be obtained.

For regular users of the system, it is possible to define a personal profile in which the user's favorite floors can be programmed beforehand. The user can also define his/her own favorite floors himself/herself via a data network, e.g. via an appointed or authorized data network person. The favorite floors can be defined automatically by statistically observing the user's most favored destination floor selections from the starting floor in question.

The personal identifier included in the card also enables the use of special functions. For example, in the case of a handicapped customer, the elevator door can be held open for a somewhat longer time by default than usual. By defining personal quick selection alternatives, the user can e.g. reach a given floor. One possibility is to provide faster elevator service to so-called priority customers than to others, in other words, a priority customer's call is served first regardless of other calls valid.

The identifier card according to the embodiment example may be a building-specific card or it may be a general-purpose card. In the case of a general-purpose card, the floors have to be programmed e.g. in such a way that each bubble switch or bar code represents that floor to which the user arriving in the building is going (e.g. the floor on which the user's home is located or the floor where the work room at his/her job is located), while similarly another bubble switch or bar code represents the exit floor or lobby floor.

In the example according to FIG. 3*a*, one or more user-specific quick selection alternatives (31) for the user's destination floor have been programmed to be shown on the display of the destination call device. The user can easily and comfortably select one of his/her own favorite floors by pressing a single button. The terminal may be a touch-screen display, in which case it is operated by touching the display area. The terminal may also be provided with a separate display device and a keypad.

When a person identified by the system approaches an RFID reader, base station or other identifying device, the terminal automatically shows the user's favorite floors, from which the user selects a desired destination floor.

It is also possible to add the favorite floors to a keypad in the manner illustrated in FIG. 3*b*. In the display in FIG. 3*b*, first e.g. Quick key (311) is pressed, whereupon one of the number keys is pressed to select a quick selection alternative. Each number key can be defined for one the favorite floors of the identified user. Users other than regular users of the building can enter a call as numbers or a separate call input system is provided for them.

The destination call device illustrated in FIGS. 3*a* and 3*b* allows the user to define his/her favorite floors in his/her own profile himself/herself, but they can also be defined automatically by statistically observing the user's most favored destination floor selections from the starting floor in question. Quick selection alternatives are given on a building-specific basis and they can be assigned descriptive names on the display of the call device.

FIG. 4 presents an example of an elevator system according to the invention. The user is identified e.g. by means of an RFID detector (24) on the floor level. Based on the identification, the destination call device (43) gives the user user-specific quick selection alternatives, from which the user selects a desired destination floor. The destination call device (43) transmits the destination call as well as information regarding the starting floor to the elevator control system (44), which allocates an elevator to the person having entered the call. When the person having entered the call is in the elevator car, a receiver (41) in the elevator car (45) again identifies the person and acknowledges the destination call to the elevator control system.

Although in the examples described above an access card or a fixed destination call device placed on a building floor is proposed as a destination call device, it is equally possible to use the user's own mobile station, PDA device (Personal Digital Assistant) or similar terminal for user identification or for the entry of a destination call.

It is obvious to the person skilled in the art that the invention is not limited to the embodiments described above, in which the invention is described by way of example, but that many variations and different embodiments of the invention are possible within the scope of the inventive concept defined in the claims presented below.

The invention claimed is:

1. A method for verifying a destination call in an elevator system, the method comprising the steps of:

identifying the person entering a call and the starting floor of the person entering the call;

entering a destination call by means of a destination call device outside the elevator car, the destination call device being operable in a plurality of buildings and having therein predefined user profiles and at least two personal quick selectors, each of said personal quick selectors when selected transmitting a request for a particular destination call;

transmitting the destination call to the elevator control system for allocation;

allocating on the basis of the destination call an elevator to the person having entered the call; and when the person having entered the call is in the elevator car, identifying the person and acknowledging the destination call in the elevator control system as executed, and recognizing whether the person having entered the call did not board the elevator allocated to the person and keeping the destination call valid.

2. A method according to claim 1, wherein the person entering a destination call is identified by means of an RFID detector, mobile station or remotely readable card.

3. A method according to claim 1, wherein the method further comprises the step of:

defining for the call device on the basis of the identification at least one user-specific selection alternative for the entry of a destination call.

4. A method according to any one of the preceding claims 1-3, wherein the method further comprises the step of:

placing in the call device one or more RFID resonant circuits and/or bar codes.

5. A method according to claim 4, wherein the method further comprises the step of:

entering a destination call selection by closing a desired resonant circuit by means of a switch.

6. A method according to claim 4, wherein the method further comprises the step of:

entering a destination call selection by showing a desired bar code to a reader device.

7. A method according to any one of claims 3, wherein the method further comprises the steps of:

defining one or more of the user's favorite floors as selection alternatives in the destination call device.

8. A method according to claim 1, wherein the method further comprises the step of:

collecting user-specific statistical information regarding the user's destination floor selections from different starting floors in the building; and defining for the destination call device at least one selection alternative from among the user's most frequent destination floor selections from a given starting floor.

9. A system for verifying a destination call in an elevator system, said system comprising at least one elevator;

an elevator control system for allocating an elevator to a person entering a call;

wherein the system further comprises:

an identifying device for identification of the person entering a call and the starting floor;

a destination call device for the entry of a destination call defining a destination floor, the destination call device being operable in a plurality of buildings and having therein predefined user profiles and at least two personal quick selectors, each of said personal quick selectors when selected transmitting a request for a particular destination call; and identification means for re-identifying the person having entered the call when the person is in the elevator car.

10. A system according to claim 9, characterized in that the aforesaid identifying device for identification of the person entering a call and the starting floor is an RFID detector, mobile station or remotely readable card.

11. A system according to any one of claims 9-10, wherein the system further comprises:

means for defining at least one selection alternative for the destination call device on the basis of the identification of the user.

12. A system according to claim 9, wherein the aforesaid destination call device further comprises:

at least one REID resonant circuit and/or bar code.

13. A system according to claim 12, wherein the aforesaid REID resonant circuit comprises at least one switch for closing the resonant circuit.

14. A system according to claim 9, wherein the system further comprises:

means for defining one or more of the user's favorite floors as a selection alternative for the destination call device on the basis of the identification of the user.

15. A system according to claim 9, wherein the system further comprises:

means for collecting user-specific statistical information regarding the user's destination floor selections from different starting floors; and means for defining at least one quick selection alternative in the destination call device from among the user's most frequent destination floor selections from a given starting floor.

16. A method according to claim 1, wherein the personal profiles define characteristics of the user which may define the operation of the elevator.

17. A method according to claim 16, wherein the defined operation of the elevator includes the length of time the elevator doors are open.

18. A system according to claim 9, wherein the personal profiles define characteristics of the user which may define the operation of the elevator.

19. The system according to claim 18, wherein the defined operation of the elevator includes the length of time the elevator doors are open.

20. The method according to claim 1, wherein if the person having entered the call did not board the elevator allocated to the person and the destination call is kept valid then another elevator is allocated to the person.

* * * * *